United States Patent [19]

Shibuya et al.

[11] 4,144,002

[45] Mar. 13, 1979

[54] ROTARY COMPRESSOR

[75] Inventors: Tsunenori Shibuya; Yutaka Ishizuka; Teruo Nakamura, all of Konan, Japan

[73] Assignee: Diesel Kiki Company, Ltd., Tokyo, Japan

[21] Appl. No.: 795,627

[22] Filed: May 10, 1977

[30] Foreign Application Priority Data

May 15, 1976 [JP] Japan ..... 51/61853[U]

[51] Int. Cl.[2] ..... F01C 21/04; F04C 29/02

[52] U.S. Cl. ..... 418/76; 418/81; 418/82; 418/93; 418/94; 418/100

[58] Field of Search ..... 418/76, 81, 82, 93, 418/94, 97-100

[56] References Cited

U.S. PATENT DOCUMENTS

| | | | |
|---|---|---|---|
| 3,385,513 | 5/1968 | Kilgore | 418/98 |
| 3,385,514 | 5/1968 | Kilgore et al. | 418/98 |

FOREIGN PATENT DOCUMENTS

| | | | |
|---|---|---|---|
| 116,014 | 10/1942 | Australia | 418/97 |
| 459,056 | 4/1928 | Fed. Rep. of Germany | 418/93 |

*Primary Examiner*—John J. Vrablik
*Attorney, Agent, or Firm*—David G. Alexander

[57] ABSTRACT

A rotor is operatively provided in a bore of a cylinder which is formed with an inlet and an outlet. The cylinder is enclosed by a housing with an annular chamber being defined between the cylinder and the housing. The housing has an inlet which is connected to the inlet of the cylinder. The outlet of the cylinder is provided at an upper portion thereof. An oil sump is defined by a lower portion of the annular chamber of the housing. A partition divides the interior of the housing into the annular chamber within which the cylinder is disposed and an outlet chamber which communicates with an outlet of the housing. The lower portion of the partition is cut away to communicate the annular chamber with the outlet chamber. An oil passageway leads from the oil sump through the rotor to the inlet of the housing in such a manner that oil flows through the oil passageway to lubricate the internal parts of the rotor and is entrained in operating fluid at the inlet of the housing, passing through the cylinder to lubricate areas of sliding contact between the rotor and the inner periphery of the cylinder. The operating fluid and oil expand and change direction in the annular chamber so that the operating fluid passes to the outlet chamber but the entrained oil is precipitated and returns to the oil sump.

4 Claims, 3 Drawing Figures

ROTARY COMPRESSOR

BACKGROUND OF THE INVENTION

The present invention relates to a rotary compressor which is especially suited for use in compressing a refrigerant fluid in an air conditioning system for a motor vehicle or a building.

A rotary compressor has been developed in which a lubricating oil sump is pressurized by refrigerant fluid at the compressor outlet. An oil passageway leads from the oil sump through the pump rotor to the inlet, oil being forced through the oil passageway and lubricating the internal parts of the rotor. At the inlet, the oil is entrained in the refrigerant fluid and compressed therewith, lubricating the areas of sliding contact between the rotor and a cylinder in which the rotor is operatively disposed.

The oil must be removed from the refrigerant fluid and returned to the oil sump before the refrigerant fluid is discharged from the compressor. If the oil were allowed to remain entrained in the refrigerant fluid as the same is passed through the axternal refrigerant circuit, the cooling efficiency would be drastically reduced. In addition, the amount of oil in the compressor may drop so low that the rotor would seize in the cylinder.

Two means have been heretofore proposed to remove the entrained oil from the refrigerant fluid at the outlet of the compressor. The first method is to provide a large expansion chamber between the outlet of the cylinder and the outlet of the compressor. Expansion of the refrigerant fluid in the expansion chamber causes the entrained oil to precipitate and return to the oil sump under the influence of gravity. One drawback of this method is that the necessarily large size of the expansion chamber increases the overall size of the compressor to an unacceptable extent. Another drawback is that since the fluid takes the shortest path through the expansion chamber the reduction of velocity is not sufficient for gravity to effectively separate the oil from the refrigerant fluid.

The second method is to provide a wire gauze oil separating filter in the outlet of the compressor. These filters, however, are unsatisfactory since they clog easily, thereby obstructing the fluid flow through the compressor. In addition, such filters must be replaced periodically, thereby imposing an undesirable maintenance requirement.

SUMMARY OF THE INVENTION

In accordance with the present invention, a rotor is operatively provided in a bore of a cylinder which is formed with an inlet and an outlet. The cylinder is enclosed by a housing with an annular chamber being defined between the cylinder and the housing. The housing has an inlet which is connected to the inlet of the cylinder. The outlet of the cylinder is provided at an upper portion thereof. An oil sump is defined by a lower portion of the annular chamber of the housing. A partition divides the interior of the housing into the annular chamber within which the cylinder is disposed and an outlet chamber which communicates with an outlet of the housing. The lower portion of the partition is cut away to communicate the annular chamber with the outlet chamber. An oil passageway leads from the oil sump through the rotor to the inlet of the housing in such a manner that oil flows through the oil passageway to lubricate the internal parts of the rotor and is entrained in operating fluid at the inlet of the housing, passing through the cylinder to lubricate areas of sliding contact between the rotor and inner periphery of the cylinder. The operating fluid and oil expand and change direction in the annular chamber so that the operating fluid passes to the outlet chamber but the entrained oil is precipitated and returns to the oil sump.

It is an object of the present invention to provide a rotary compressor comprising an effective means for removing entrained oil from an operating fluid passing therethrough.

It is another object of the present invention to provide a rotary compressor in which the operating components are arranged in a novel and unique manner to separate entrained oil from operating fluid without recourse to additional components such as oil separating filters.

It is another object of the present invention to provide a rotary compressor in which oil is effectively separated from operating fluid in an annular chamber utilizing the combined effects of expansion, change of direction and gravity in a unique manner.

It is another object of the present invention to improve the operation of a rotary compressor in combination with reducing the manufacturing cost thereof.

It is another object of the present invention to provide a rotary compressor of reduced size over the prior art.

It is another object of the present invention to provide a generally improved rotary compressor.

Other objects, together with the foregoing, are attained in the embodiment described in the following description and illustrated in the accompanying drawing.

DESCRIPTION OF THE PREFERRED EMBODIMENT

Figure 1:
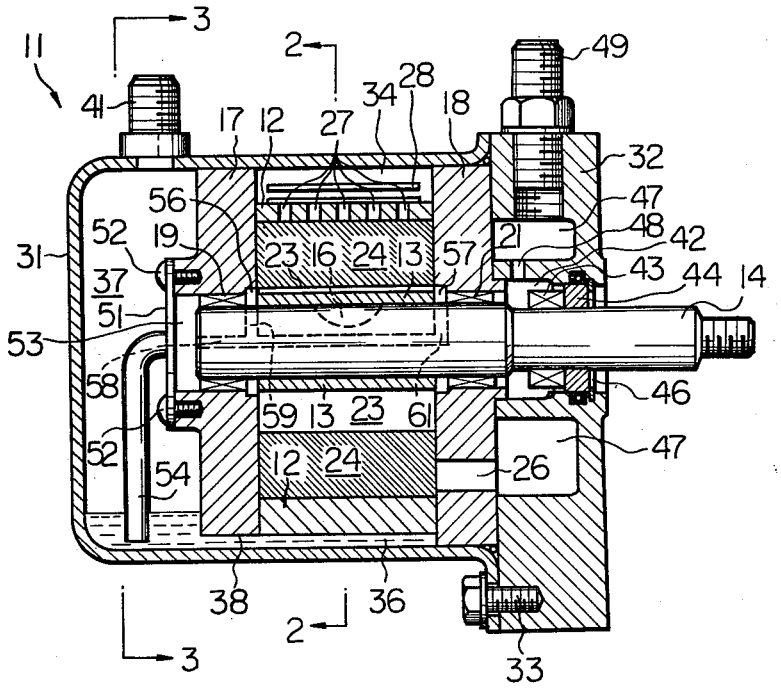
FIG. 1 is a sectional elevation of a rotary compressor embodying the present invention.

While the rotary compressor of the invention is susceptible of numerous physical embodiments, depending upon the environment and requirements of use, substantial numbers of the herein shown and described embodiment have been made, tested and used, and all have performed in an eminently satisfactory manner.

Referring now to the drawing, a rotary compressor embodying the present invention is generally designated by the reference numeral 11 and comprises a bored cylinder 12. A rotor body 13 is rotatable in the bore of the cylinder 12 and is fixed to a rotor shaft 14 by means of a key 16. Sealingly fixed to the opposite ends of the cylinder 12 by bolts 15 are end plates 17 and 18 respectively. The shaft 14 is rotatably supported by the end plates 17 and 18 by bearings 19 and 21 provided in holes (no numerals) formed through the respective end plates 17 and 18. The right end, as viewed in FIG. 1, of the shaft 14 extends externally of the compressor 11 proper and is adapted to be driven from, for example, an engine of an automotive vehicle through an electromagnetic clutch (not shown).

The rotor body 13 is coaxially mounted on the shaft 14 but both the rotor body 13 and shaft 14 are eccentrically mounted in the cylinder 12. The bore of the cylinder 12 is preferably circular, and the rotor body 13 is tangent to the inner surface of the bore at an upper portion which is designated at 22. The rotor body 13 is formed with four equally angularly spaced radial slots 23 in which are slidingly disposed vanes 24. The vanes 24 are urged outwardly by lubricant pressure as will be described in detail below to sealingly engage with the inner surface of the bore of the cylinder 12. In addition, the ends of the rotor body 13 and vanes 24 sealingly engage with the conjugate inner surfaces of the end plates 17 and 18.

An inlet 26 is formed through the end plate 18 and leads into the bore of the cylinder 12. An outlet 27 from the bore of the cylinder 12 is constituted by a plurality of holes formed through the wall of the cylinder 12 at an upper portion thereof. A flapper valve 28 is mounted to the outlet 27 to allow fluid flow only out of the cylinder 12 therethrough.

A housing 31 and end cover 32 are sealingly joined together by bolts 33 to enclose the cylinder 12 and end plates 17 and 18. Whereas the outer diameter of the end plates 17 and 18 is equal to the inner diameter of the housing 31 so that the end plates 17 and 18 are a sealing fit in the housing 31, the cylinder 12 is smaller in diameter than the end plates 17 and 18. In this manner, an annular chamber 34 is defined between the cylinder 12, housing 31 and end plates 17 and 18. The lower portion of the annular chamber 34 constitutes a sump 36 for lubricant oil. Moreover, the end plate 17 serves as a partition separating the annular chamber 34 from a discharge chamber 37. The lower portion of the end plate 17 is cut away below an edge 38 to define a hole 39 connecting the annular chamber 34 with the discharge chamber 37. An outlet connector 41 leads from the discharge chamber 37 for communication of the same with a condenser of an air conditioning system (not shown).

The end cover 32 is formed with a seal chamber 42 through which the shaft 14 passes. A shaft seal 43 and a disc 44 sealingly surround the shaft 14 and the disc 44 is attached to the end cover 32 by means of a snap ring 46. The end cover 32 is further formed with an annular inlet chamber 47 which communicates with the seal chamber 42 through a passageway 48. The inlet chamber 47 communicates with the bore of the cylinder 12 through the inlet 26. An inlet connector 49 connects the interior of the inlet chamber 47 with an evaporator (not shown) of the air conditioning system.

A plate 51 is sealingly fixed to the left face of the end plate 17 as viewed in FIG. 1 by means of bolts 52, defining a high pressure oil chamber 53 in conjunction with the left end of the shaft 14. A tube 54 connects the oil chamber 53 with the oil sump 36 below the level of oil therein. The bearings 19 and 21 allow oil to flow around the shaft 14. Annular grooves 56 and 57 are cut in the inner faces of the end plates 17 and 18 respectively which extend radially outwardly of the bottoms of the slots 23 in the rotor body 13. The oil chamber 53 communicates with the grooves 56 and 57 through an axial passageway 58 and radial passageways 59 and 61 formed through the shaft 14.

Figure 2:
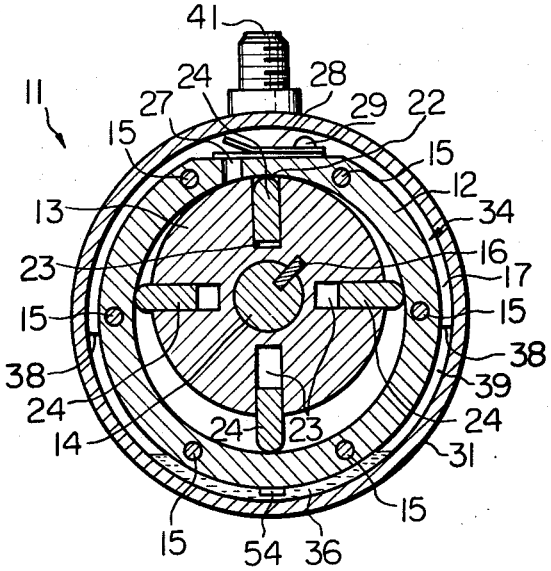
FIG. 2 is a sectional view taken on a line 2—2 of FIG. 1.
Figure 3:
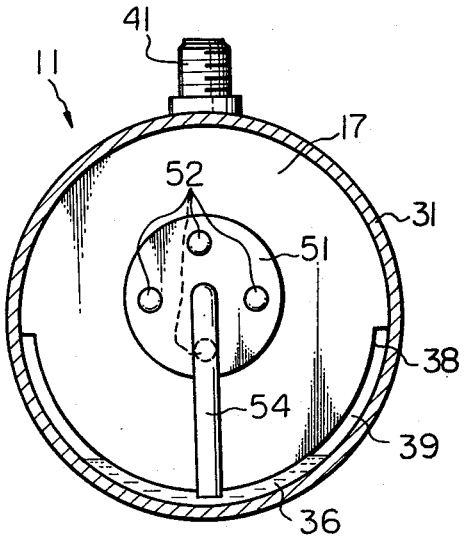
FIG. 3 is a sectional view taken on a line 3—3 of FIG. 1.

In operation, the rotor shaft 14 and body 13 are driven for counterclockwise rotation as viewed in FIG. 2 from the engine. The vanes 24 partition the bore of the cylinder 12 into four working chambers which are not designated by reference numerals but which increase in volume in the vicinity of the inlet 26 and decrease in volume in the vicinity of the outlet 27 due to the eccentricity of the rotor body 13 in the cylinder 12. This creates suction at the inlet 26 which causes refrigerant fluid to enter the cylinder 12 through the inlet connector 49, inlet chamber 47 and inlet 26. The refrigerant fluid is compressed in the cylinder 12 and discharged therefrom through the outlet 27 into the annular chamber 34. The refrigerant fluid passes through annular chamber 34 and hole 39 into the discharge chamber 37 from which it is discharged from the compressor 11 through the outlet connector 41.

The moving parts of the compressor 11 are lubricated in the following manner. The high refrigerant pressure in the annular chamber 34 and sump 36 forces oil from the sump 36 into the oil chamber 53 through the pipe 54. From the oil chamber 53 the oil passes through the bearing 19 into the groove 56, thereby lubricating the bearing 19. From the groove 56 the oil flows into the radially inner portions of the grooves 23 in the rotor body 13 between the bottoms of the slots 23 and the vanes 24. The oil in the slots 23 serves the dual function of lubricating the areas of sliding contact between the vanes 24 and the walls of the slots 23 and urging the vanes 24 radially outwardly into sealing engagement with the inner surface of the bore of the cylinder 12. From the slots 23 the oil flows through the groove 57 and bearing 21 into the seal chamber 42 thereby lubricating the bearing 21. Oil also flows to the grooves 56 and 57 through the passageways 58, 59 and 61 to augment the oil supply during start-up of the compressor 11.

From the seal chamber 42 the oil flows through the passageway 48 into the inlet passageway 47 in which it is entrained in the refrigerant fluid due to the high flow velocity of refrigerant fluid through the inlet chamber 47. It will be noted that the low pressure in the inlet chamber 47 and thereby the seal chamber 42 combines with the high pressure in the oil chamber 53 to promote oil flow through the rotor body 13. Thus, the pipe 54, oil chamber 53, bearing 19, groove 56, slots 23, groove 57, bearing 21, seal chamber 42 and passageway 48 constitute a lubricant passageway (not designated) leading from the oil sump 36 to the inlet chamber 47.

The refrigerant fluid and entrained oil are compressed in the cylinder 12 and discharged therefrom through the outlet 27. The entrained oil lubricates the areas of sliding contact of the radially outer ends of the vanes 24 and the inner surface of the bore of the cylinder 12 in a very effective manner. The refrigerant fluid and entrained oil then pass downwardly through the annular chamber 34 and the hole 39 to the discharge chamber 37.

During passage through the annular chamber 34, the refrigerant fluid expands to a considerable extent, undergoes a radical change in direction and is greatly decelerated. The combination of these three factors, in addition to gravity, cause the entrained oil to precipitate out of the refrigerant fluid onto the surfaces defining the annular chamber 34 and run down the same into the oil sump 36. In other words, the oil is separated from the refrigerant fluid in the annular chamber 34 and returns to the oil sump 36.

On the other hand, the refrigerant fluid, with the oil removed, passes through the hole 39 into the discharge chamber 37 in which further deceleration, expansion and change of direction occur. Any small amount of oil still entrained in the refrigerant fluid is precipitated out in the discharge chamber 37 and runs down into the oil sump 36. From the discharge chamber 37 the purified refrigerant fluid leaves the compressor 11 through the outlet connector 41.

It will be understood that the annular chamber 34, hole 39 and discharge chamber 37 constitute an expansion passageway forcing the refrigerant fluid to change direction, decelerate and expand in several stages, effectively forcing the entrained oil to precipitate out of the refrigerant fluid and return to the oil sump 36. Thus, the object of effectively separating the oil from the refrigerant fluid is accomplished without the necessity of additional compressor components and/or a large separation chamber which would increase the overall size of the compressor 11.

Various modifications will become possible for those skilled in the art after receiving the teachings of the present disclosure without departing from the scope thereof.

What is claimed is:

1. A rotary compressor comprising:

a bored cylinder formed with an inlet and an outlet;

a rotor operatively disposed in the bore of the cylinder for compressing fluid therein;

a housing enclosing the cylinder and being formed with an inlet and an outlet;

a passageway connecting the inlet of the housing to the inlet of the cylinder;

a lubricant sump defined by a lower portion of the housing, the outlet of the housing communicating with the lubricant sump;

a lubricant passageway leading from the lubricant sump through the rotor to the inlet of the cylinder;

an expansion passageway defined within the housing connecting the outlet of the cylinder with the lubricant sump;

an annular chamber defined between the cylinder and the housing; and an axial partition provided in the housing between the cylinder and the outlet of the housing, the partition being formed with a hole therethrough, the remainder of the periphery of the partition sealingly engaging the housing, the expansion passageway being constituted by the annular chamber and the hole, the outlet of the cylinder being formed at an upper portion thereof, a lower portion of the partition being cut away to constitute the hole, the outlet of the cylinder communicating with the lubricant sump and the outlet of the housing only through the expansion passageway.

2. A rotary compressor as in claim 1, further comprising an outlet chamber defined by the partition and the housing leading from the expansion passageway to the outlet of the housing.

3. A rotary compressor as in claim 2, in which the rotor comprises a rotor body eccentrically rotatably disposed inside the cylinder and a plurality of radial vanes carried by the rotor body and sealingly engaging with an inner periphery of the cylinder.

4. A rotary compressor as in claim 3, in which the rotor body is formed with slots in which the vanes are respectively radially slidable, the lubricant passageway extending through the slots radially inwardly of the vanes, lubricant pressure in the lubricant passageway urging the vanes radially outwardly into sealing engagement with the inner periphery of the cylinder.

* * * * *